US005797453A

United States Patent [19]

Hisaw

[11] Patent Number: 5,797,453

[45] Date of Patent: Aug. 25, 1998

[54] APPARATUS FOR KICKING OVER TOOL AND METHOD

[75] Inventor: Jack C. Hisaw, Carencro, La.

[73] Assignee: Specialty Machine & Supply, Inc., Scott, La.

[21] Appl. No.: 542,444

[22] Filed: Oct. 12, 1995

[51] Int. Cl.[6] ..... E21B 7/06

[52] U.S. Cl. ..... 166/117.5; 166/241.5

[58] Field of Search ..... 166/117.5, 381, 166/386, 241.5, 242.5, 316; 175/4.51, 4.52

[56] References Cited

U.S. PATENT DOCUMENTS

| | | | |
|---|---|---|---|
| Re. 31,155 | 2/1983 | Crocker | 166/117.5 |
| 2,856,008 | 10/1958 | Spencer | 166/117.5 |
| 3,827,489 | 8/1974 | McGowen, Jr. | 166/117.5 |
| 3,827,490 | 8/1974 | Moore, Jr. et al. | 166/117.5 |
| 3,828,853 | 8/1974 | Neal | 166/117.5 |
| 3,867,983 | 2/1975 | Neal | 166/117.5 |
| 3,899,025 | 8/1975 | Dinning | 166/115.5 |
| 4,039,026 | 8/1977 | Yonker | 166/117.5 |
| 4,169,505 | 10/1979 | Neal | 166/117.5 |
| 5,415,238 | 5/1995 | Nice | 166/381 |

*Primary Examiner*—Frank Tsay

*Attorney, Agent, or Firm*—Domingue, Delaune & Waddell

[57] ABSTRACT

A device for use within a production conduit is disclosed. Generally, the device comprises a body attached to a work string. A deflection member, operatively attached to the body, is included for allowing the deflection of a body mandrel. An aligning spring for aligning the device with a gas lift pocket within the production conduit is included along with a tension adjusting member used for creating a tension in the aligning spring. The device may further comprise a sleeve disposed about the deflection member so that the deflection member is held in a rigid position, with the sleeve being selectively attached to the body. A method for lowering a bottom hole assembly containing a gas lift valve into a side pocket gas lift mandrel is also included.

4 Claims, 7 Drawing Sheets

APPARATUS FOR KICKING OVER TOOL AND METHOD

BACKGROUND OF THE INVENTION

This invention relates to a device used in an oil and gas well bore. More particularly, but not by way of limitation, this invention relates to a device used in gas lift operations including installation and retrieval of gas lift valves.

A well will generally be completed to a hydrocarbon bearing reservoir. As production of the hydrocarbons proceeds through time, the reservoir will steadily lose pressure. Pressure is an important factor in the production of oil and gas to the surface.

Gas lift is the method of artificial lift that uses an external source of high-pressure gas for supplementing formation gas to lift the well fluids to the surface. Various types of gas lift devices have been developed through-out the years. Two important systems include continuous-flow gas lift and intermittent gas lift.

The continuous-flow gas lift is the only method of artificial lift that fully utilizes the energy in the formation gas production. Many wells are gas lifted by continuous flow, which can be considered an extension of natural flow by supplementing the formation gas with additional high pressure gas from an outside source. Gas is injected continuously into the production conduit at a maximum depth on the basis of the available injection gas pressure.

Intermittent gas lift requires high instantaneous gas volumes to displace liquid slugs to the surface. The intermittent gas lift method requires an "on-off" need for high pressure gas. Most high pressure gas lift systems are designed to recirculate the lift gas. The low pressure gas from the production separator is compressed and reinjected into the well to lift the fluids from the well. Most wells can be depleted by gas lift.

The primary means for placing the high pressure gas from the casing annulus into the internal diameter of the production conduit is via a gas lift valve located in a mandrel, with the mandrel being part of the production conduit. Many efficient gas lift installations with wire line retrievable gas lift valve mandrels are designed with minimal well information for locating the mandrel depths on initial well completion. Highly deviated wells that produce sand and have a high formation gas/liquid ratio are excellent candidates for gas lift when artificial lift is needed. Many gas lift installations are designed to increase daily production from flowing wells.

The valve mandrel was designed with a pocket, or receiver, within the mandrel. A gas lift valve can be removed or installed by simple wire line operations, as is understood by those of ordinary skill in the art. The use of wire line eliminates the need to pull the entire production conduit from the well bore when an operator determines that it is necessary to change out valves.

The primary wire line device for locating the mandrel pocket and selectively removing or installing a gas lift valve is a kick-over tool. The mandrel is called a side pocket mandrel because the pocket is offset from the centerline of the tubing. Most side pocket type retrievable valve mandrels have a full-bore internal diameter equal to the tubing internal diameter.

Many wells drilled today are highly deviated. While these highly deviated wells result in some reservoir drainage efficiencies, other problems may result. One problem includes the installing and retrieving of the gas lift valves.

Numerous devices have been attempted to ease the task of installing and retrieving gas lift valves in highly deviated wells with limited success. Therefore, there is a need for a device that will effectively and dependably install and retrieve gas lift valves. The present invention solves these problems as will be more fully explained hereinafter.

SUMMARY OF THE INVENTION

A device for use within a production conduit is disclosed. Generally, the device comprises a body attached to a work string. A deflection means, operatively attached to the body, for allowing the deflection of a mandrel is also included. An aligning means for aligning the device with a gas lift pocket within the production conduit is included along with a means for creating a tension in said aligning means and means for adjusting the tension in the aligning means.

The device may further comprise a sleeve disposed about the deflection means so that the deflection means is held in a rigid position, with the sleeve being selectively attached to the body.

In one embodiment, the means for creating the tension in the aligning means consist of a coil spring disposed about the mandrel, and the aligning means consist of a first longitudinal bow spring, and wherein the coil spring is urged against the longitudinal bow spring in order to deflect the bow spring. Further, the means for adjusting tension in the bow springs includes a housing bearing against the coil spring and capable of compressing the coiled spring so that the kinetic energy within the coiled spring may be increased or decreased.

In another embodiment, the device contains a second set of longitudinal bow springs along with a second means for adjusting the second set of bow springs. The device may further contain a second deflection means, attached at the lower end of the mandrel. The device is generally attached to a work string and the mandrel is attached to a gas lift valve, dummy valve or a retrieving tool means for retrieving a gas lift valve.

A method of setting a gas lift valve within a gas lift side pocket contained on a tubing string is also disclosed. Generally, the method comprises the steps of lowering a work string into the tubing string. The bottom hole assembly may contain: a body attached to a work string; a first and second deflection means for allowing the deflection of a mandrel at two distinct locations within the bottom hole assembly, with the mandrel being attached to the deflection means at one end and having a gas lift valve attached at the second end; aligning means for aligning the mandrel within the tubing string; means for creating a tension in the aligning means; means for adjusting the tension in the aligning means; and, a sleeve disposed about the deflection means so that the deflection means is held in a rigid position, with the sleeve being selectively attached to the body.

Then, the first deflecting means is deflected at a first location point and the second deflecting means is deflected at a second location point so that the gas lift valve is aligned with and located into the pocket. Next, the gas lift valve is set within the pocket, and the bottom hole assembly may be retrieved.

Once the operator deems it necessary to change out the gas lift valve, the method would further include lowering the above described body hole assembly with the exception that the bottom hole assembly contains a pulling tool to retrieve the gas lift valve instead of a gas lift valve, and the shifting means is pinned so that both deflection means is held rigid. The method includes lowering the bottom hole assembly past the lower most side pocket mandrel and jarring the bottom hole assembly in order to shift the sleeve so that the first deflection means is allowed to deflect in accordance with the profile of the side pocket gas lift mandrel The first and second deflection means are allowed to deflect in accordance with the profile of the tubing string; the operator locates the pocket and by further manipulation of the work string, the pulling tool engages the gas lift valve in the pocket. The operator would then pull the gas lift valve from the pocket and retrieve the bottom hole assembly and the gas lift valve from the production string. Retrieval of the remainder of the gas lift valves would continue by pinning the sleeve in a position that allows the first deflection means to deflect.

An advantage of the present invention includes the ability to adjust the tension within the aligning means. Another advantage includes that the tension of the aligning means may be adjusted on site by operator. Yet another advantage is that the aligning means may contain from four to eight longitudinal bow springs. Another advantage is that the device may be used in a variety of tubing sizes by adjusting the tension in the bow springs.

Still yet another advantage is the number of bow springs used is at the discretion of the operator. Generally, more springs will be used with larger sized gas lift valves due to the increased energy of the springs. Another advantage is that the operator may change from a four spring embodiment to an eight spring embodiment on site by operator. Another advantage is that the eight spring embodiment will contain contact points in two different axial planes.

A feature of the present invention includes use of longitudinal bow springs that enter the production conduit already is expanded. Another feature is that adjusting nuts are used in order to adjust the tension in the bow springs, and that the operator may adjust the tension at the well site.

Another feature includes the device will accommodate the multiple embodiments of bow springs so that it is possible for a four spring embodiment, or alternatively, an eight spring embodiment. This is particularly useful on offshore platforms which contains numerous wells, and gas lift work is being performed on several wells with different size production conduits. This feature allows the same device be used on different size conduits; all that is required is to change the configuration and number of bow springs to accommodate the specific production conduit configuration.

DESCRIPTION OF THE PREFERRED EMBODIMENTS

Figure 1:
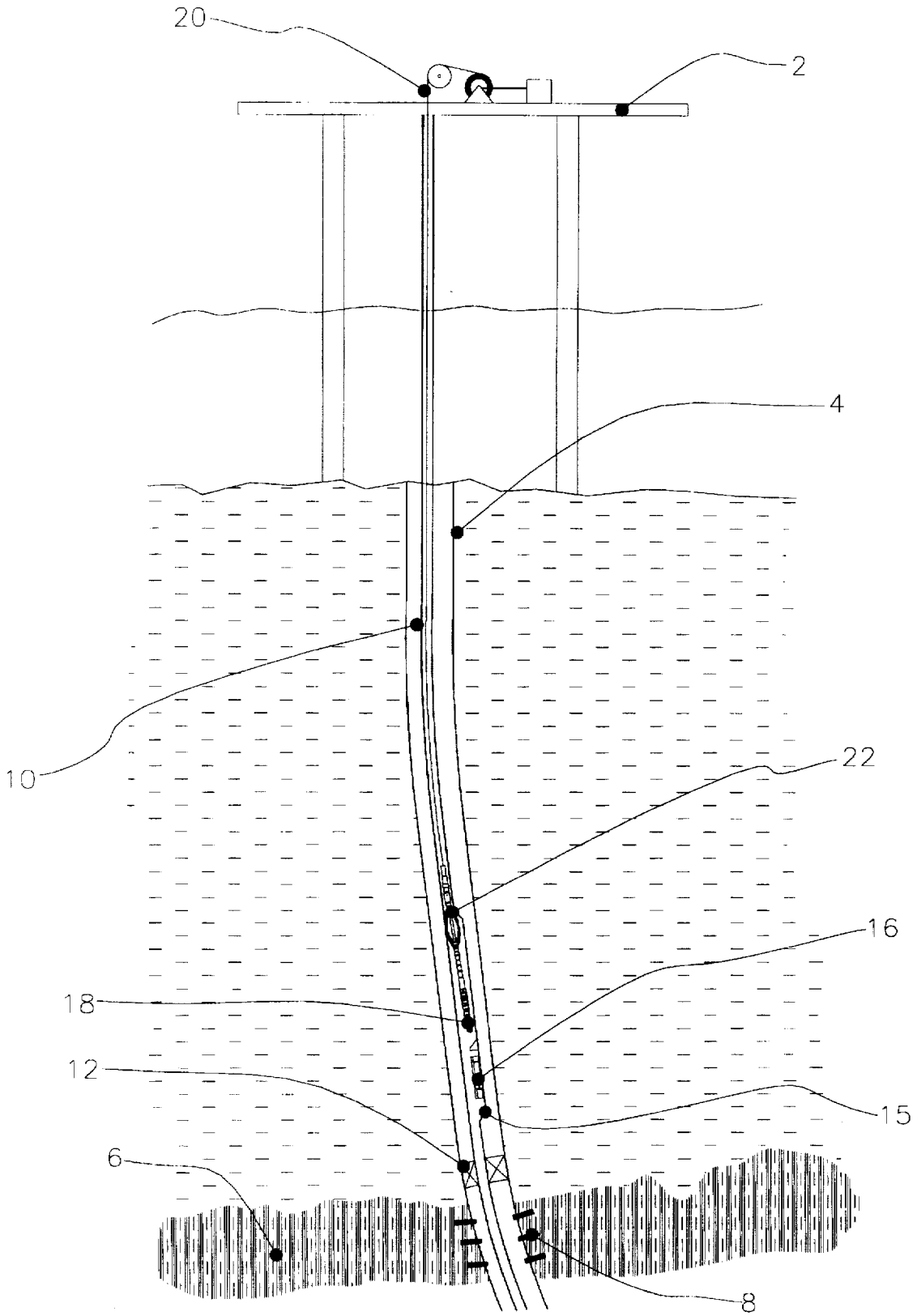
FIG. 1 is an illustration of an offshore platform that has extended therefrom a production well.

Referring to FIG. 1, an offshore platform 2 is shown. The platform 2 has extending therefrom a casing string 4, with the casing string 4 intersecting a hydrocarbon reservoir 6. The perforations 8 allow the production of the hydrocarbons into the casing string 4. The casing string 4 will have contained therein a production conduit 10 that has positioned thereon a packer 12, with an annulus 14 formed therefrom.

The production conduit 10 will also contain thereon a gas lift side pocket mandrel 15 that has contained therein a pocket 16 for placement of the gas lift valve 18. Gas lift mandrels are well known in the art and are available from Halliburton Energy Services, Camco, as well as others. It should be noted that most gas lift installations will have a series of gas lift side pocket mandrels which is well understood in the art. As depicted in FIG. 1, a work string 20 (which in the preferred embodiment is wire line, even though other types of strings are useable such as coiled tubing) can be lowered into the production conduit 10 with a bottom hole assembly consisting of the device 22 with a gas lift valve 18 attached thereto.

As depicted in FIG. 1, the work string 20 is lowered into the production conduit 10 with a bottom hole assembly including the device 22, and gas lift valve 18. The gas lift valve 18 may either be placed into the mandrel 14, or alternatively, be retrieved from the mandrel 14. It should be noted that throughout the application, like numbers refer to like components in the various drawings.

Referring now to FIG. 2, an enlarged partial sectional view of one embodiment of the present invention 22 is illustrated. The device consist of a body 30 that has external thread means 32 that extends to a fishing neck profile 34 that in turn extends to an outer first surface 36, a second surface 38, third surface 40, with the second surface 38 and the third surface 40 forming a radial shoulder 42. Extending radially inward will be the cavity 44 which is formed in a spherical shape in order to receive the deflection means, which will be described later in the application. The inner bore 46 extends from the cavity 40.

The deflection means 48 for allowing the deflection of the longitudinal center-line of the mandrel 50 relative to the longitudinal center-line of the body 30 is operatively associated with the body 30 as will be explained. Generally, the deflection means 48, which is also referred to as a knuckle joint, comprises a spherical shaped outer surface 52 that leads to a sloping surface 54 that in turn leads to an outer surface 56. The outer surface 56 terminates at the external threads 58, and extending radially inward is the internal thread means 60.

The mandrel 50 will contain external thread means 62 which cooperate with the internal thread means 60, with the thread means 62 extending to the outer surface 64. The outer surface 64 concludes at the external thread means 66. The mandrel 50 will also contain a first slot 68 and a second slot 70 through which a pin (not shown) may be inserted to prevent the first biasing means 72 and second biasing means 74 (also known as coiled springs) from rotating on the mandrel 50 as will be explained in greater detail.

The device 22 will also contain adjusting means 76 for adjusting the tension in the longitudinal bow springs 78, also known as the aligning means 78 for aligning the device 22 with the side pocket 16. In the embodiment shown, there are a first set 78A and a second set 78B of bow springs.

The adjusting means 76 comprises an outer surface 80 that terminates at the radial shoulder 82 which in turn extends to the internal thread means 84. The internal thread means 84 will extend to the radial surface 86, with the radial surface 86 concluding at the inner bore surface 88 that contains the internal threads 90. The internal threads 90 cooperate with the external thread means 58. The adjusting means 76 will abut a no-go ring 92 that is slidably mounted on the mandrel 50.

The device 22 also contains housing means for housing the bow springs 78. More specifically, the device contains the housing means 94A, 94B, 94C, and 94D. The housing means 94 includes an outer housing 96 and an inner housing 98. The outer housing 96 has an outer surface 100 that terminates at one end with the radial surface 102 that in turn extends to the inner surface and thread means 104. The second end of the outer surface contains a chamfered shoulder 106. The housing 96 will also contain a series of longitudinal slots (not shown) formed on the inner surface 104 for placement of the end of the bow springs 78.

Figure 2A:
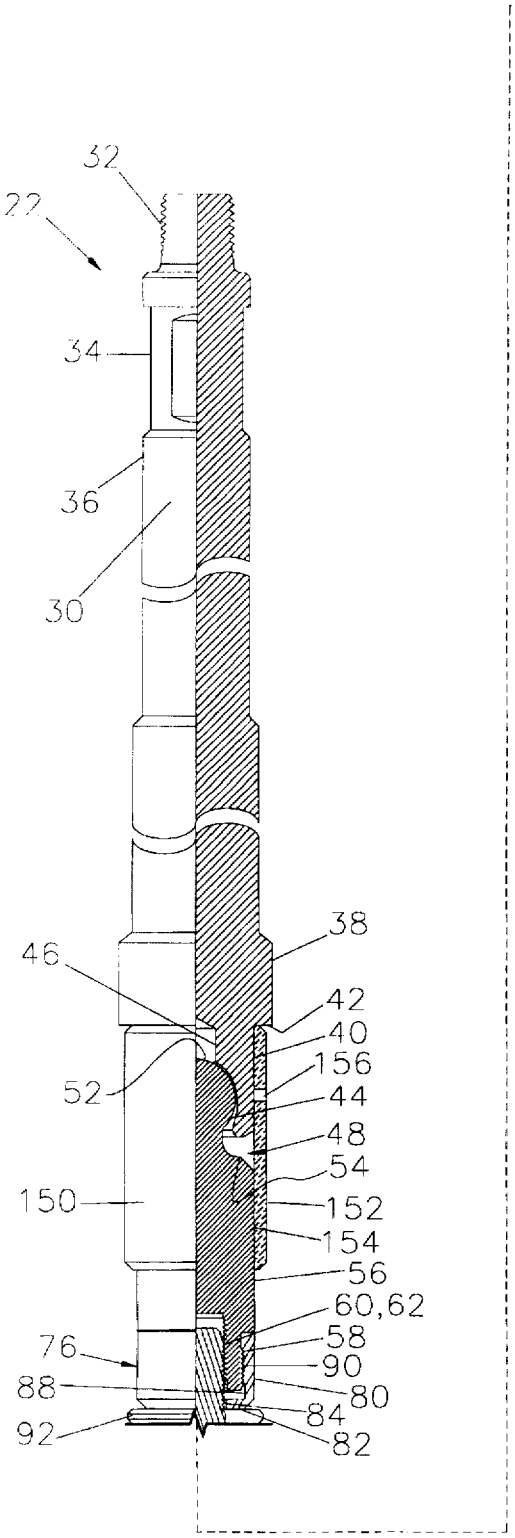
FIGS. 2A–2B are an enlarged partial sectional view of one embodiment of the present invention.

The inner housing 98 contains a surface 108 (which contains external thread means 108 that cooperates with the internal thread means 104) with the surface 108 terminating at the radial shoulder 110 at one end and shoulder 112 at the other. The radial shoulder 108 extends to the inner bore 114. The outer housing 96 and the inner housing 98 which are threadedly connected to each other are slidably mounted with the mandrel 50. As shown in FIG. 2A, the interaction between the chamfered shoulder 106 and the surface will keep the bow spring 78 locked in place. The housing means 94B, 94C, and 94D are identical in construction, and therefore, their description will not be repeated.

Figure 2B:
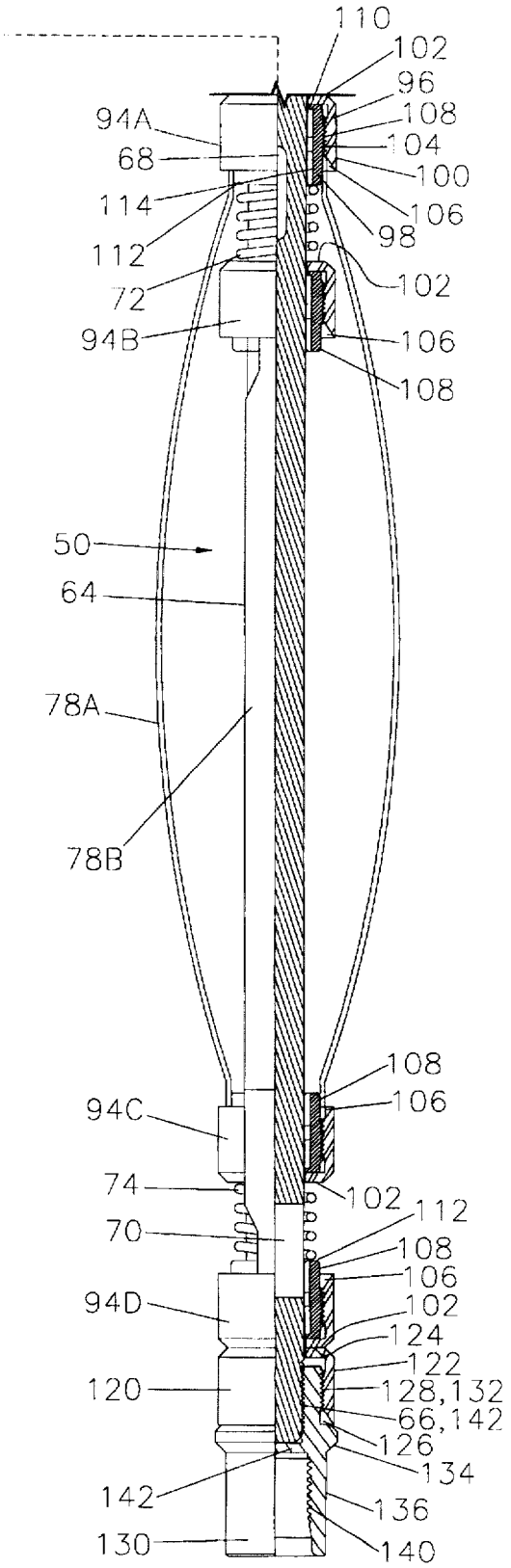

As seen in FIG. 2A, the biasing means 72 urges against shoulder 112 of housing means 94A and the radial surface 102 of housing means 94B. As seen in FIG. 2B, the biasing means 74 urges against the shoulder 112 of housing means 94D as well as urging the radial surface 102 of housing means 94C.

Also depicted in FIG. 2B is the adjusting means 120 which is similar in construction to the adjusting means 76. The adjusting means 120 contains an outer surface 122 that has at one end the radial surface 124 and at the second end the chamfered surface 126. Extending radially inward is the inner thread means 128.

The inner thread means 128 will connect to the bottom sub 130. The bottom sub 130 contains an external thread means 132 that extends to the protuberance 134 that in turn leads to the outer surface 136. Extending radially inward is the first internal thread means 138 that stretches to the solid lip 140. Extending from the lip 140 is the second internal thread means 142 which cooperates with the external threads 66 of the mandrel 50. In the four spring embodiment of FIG. 2A–2B, the bottom sub 130 will have attached to it the gas lift valve or retrieving tool for retrieving the gas lift valve, neither of which are shown.

Referring again to FIG. 2A, the device 22 also contains a shifting sleeve 150. The shifting sleeve 150 contains an outer cylindrical surface 152 and an inner bore 154. The shifting sleeve 150 will have disposed therein a first aperture 156 for placement of a set screw (not shown) as well as a second aperture for placement of a shear pin (not shown). The shear pin will hold the shifting sleeve in place as shown in FIG. 2A which causes the deflection means 48 to be rigid relative to the body 30 and the mandrel 50.

Figure 3:
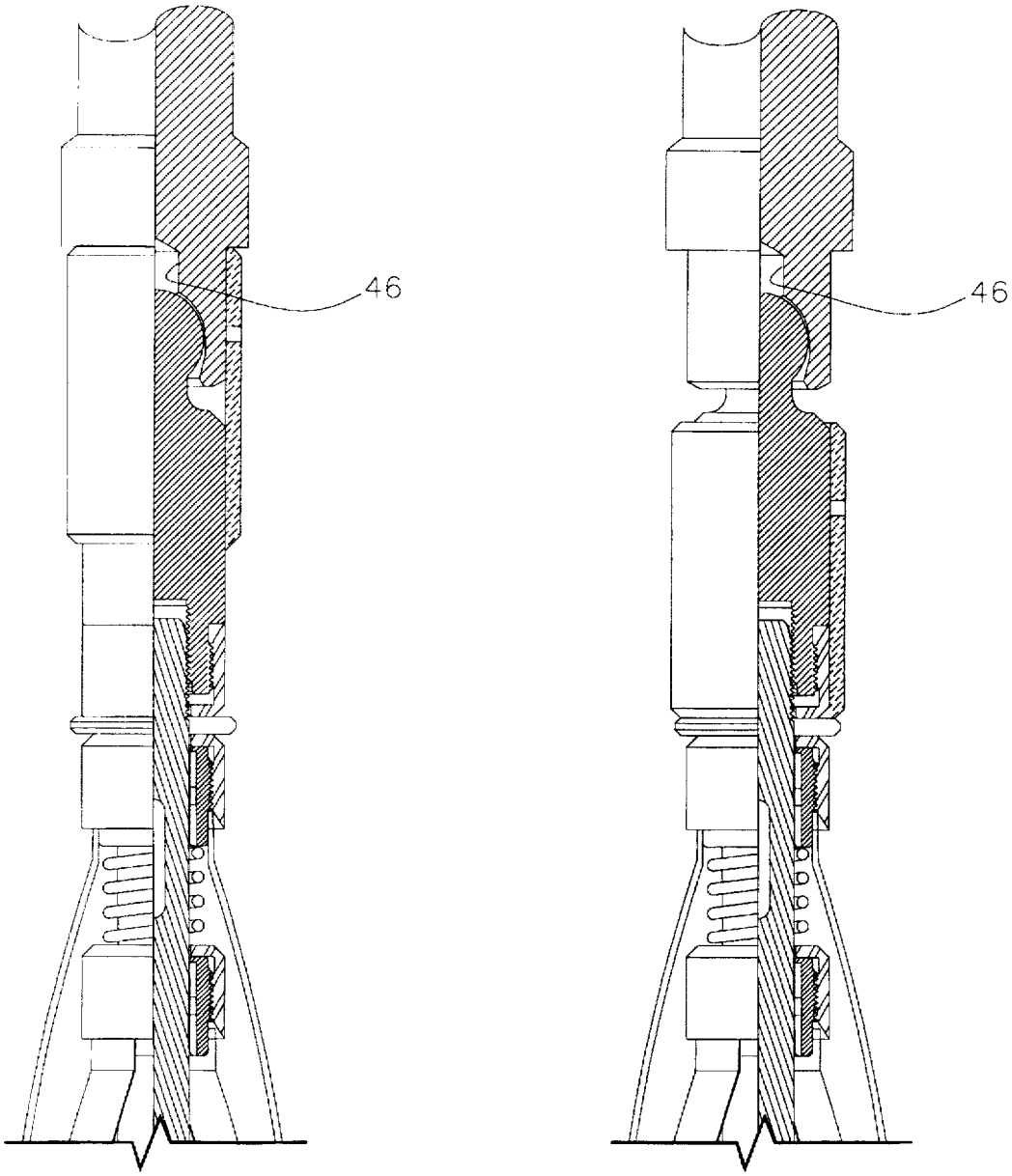
FIG. 3 is a partial sectional view of the embodiment of FIG. 2 depicting the shifting of the sleeve.

As seen in FIG. 3, and as will be further explained in the operation section, the shifting sleeve 150 may be shifted by jarring the bottom hole assembly which in turn will shear the pin so that the shifting sleeve 150 is allowed to shift downward relative to the deflection means 48. In the position shown in FIG. 3, the deflection means 48 is now able to deflect.

Figure 4A:
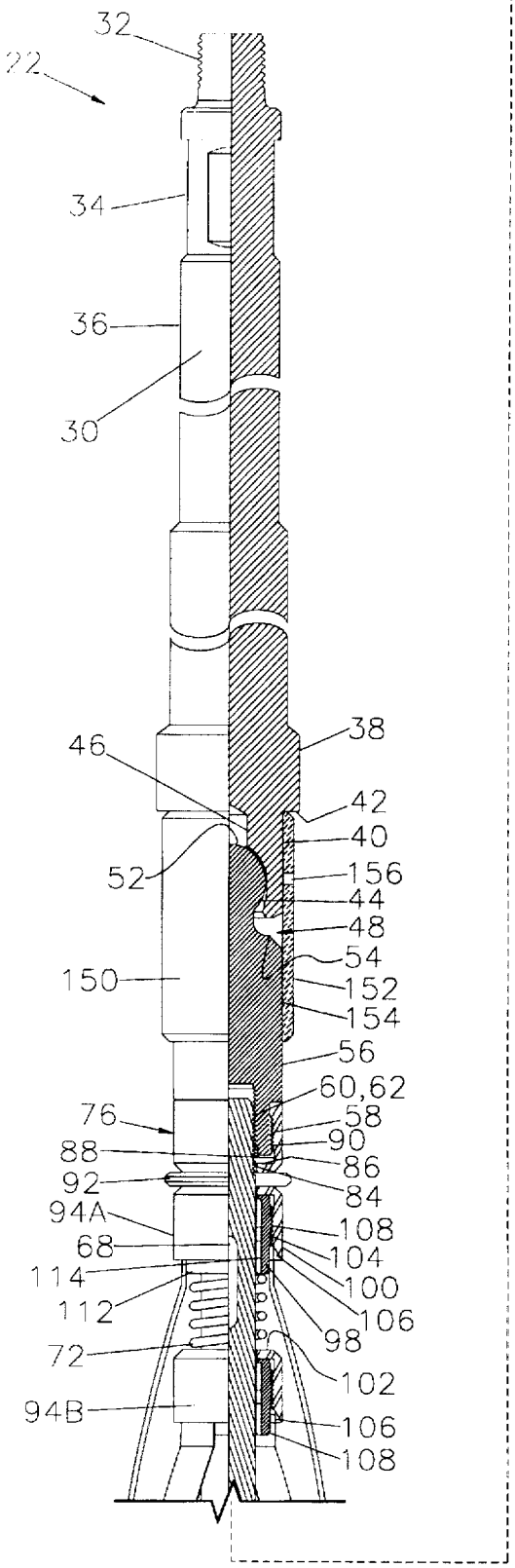
FIGS. 4A–4B are an enlarged partial sectional view of a second embodiment of the present invention.
Figure 4B:
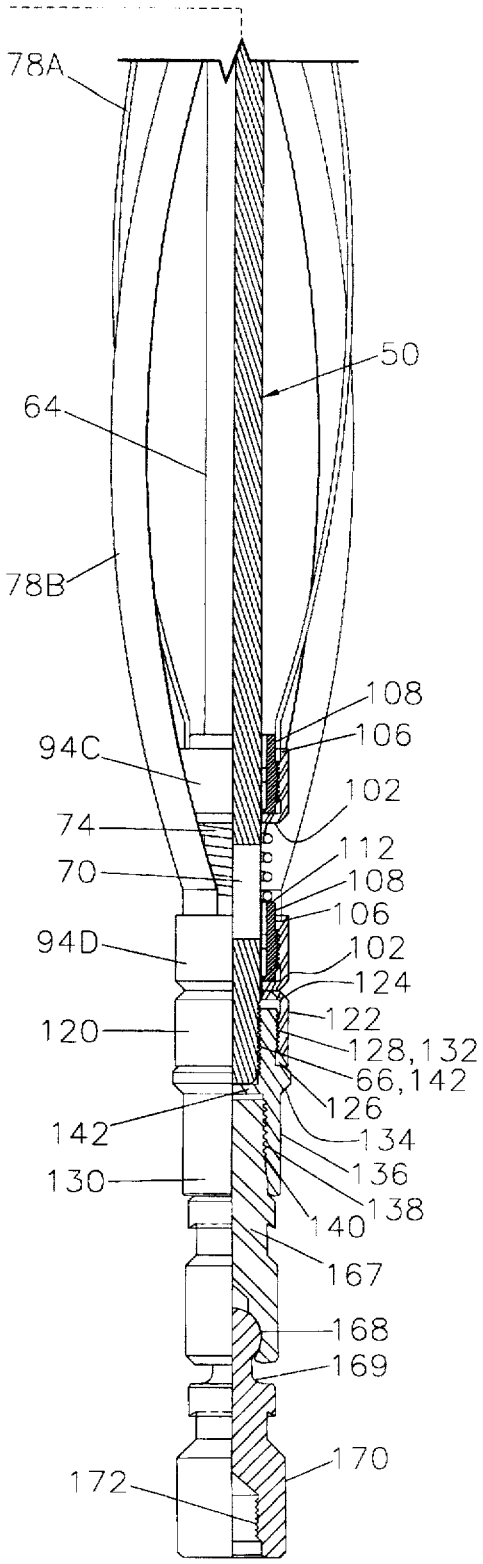

In FIGS. 4A–4B, the eight spring embodiment of the invention is illustrated. FIGS. 4A–4B has a differences when compared to that of the embodiment of FIGS. 2A–2B: the embodiment of FIG. 4A–4B will also contain a second deflection means 166. The second deflection means 166 is similar in construction from the first deflection means 48. The second deflection means 166 may have attached to it either a gas lift valve or pulling tool for retrieving the gas lift valve.

The deflection means 166 generally comprises a sub 167 having an inner profile shaped in a spherical cavity. The second portion contains a spherical shaped outer surface 168 that leads to a sloping surface 169 that in turn leads to an outer surface 170. The outer surface 179 will extend radially inward to the internal thread means 172.

Additional springs 78 are generally used when working with larger sized gas lift valves. Thus, a four-spring embodiment may be used with 1" gas lift valves in the KB series gas lift mandrels while an eight-spring embodiment seen in FIGS. 2, 3, and 4 may be used with 1.5" gas lift valves in the MM series gas lift mandrels. The increase number of springs gives added energy to ensure that once the device 22 reaches the gas lift mandrel, and in particular the belly 174 of the mandrel (as seen in FIGS. 5, 6 and 7), the longitudinal bow springs 78A and 78B will adequately kick the tool string over, as will be more fully explained.

OPERATION

Figure 5:
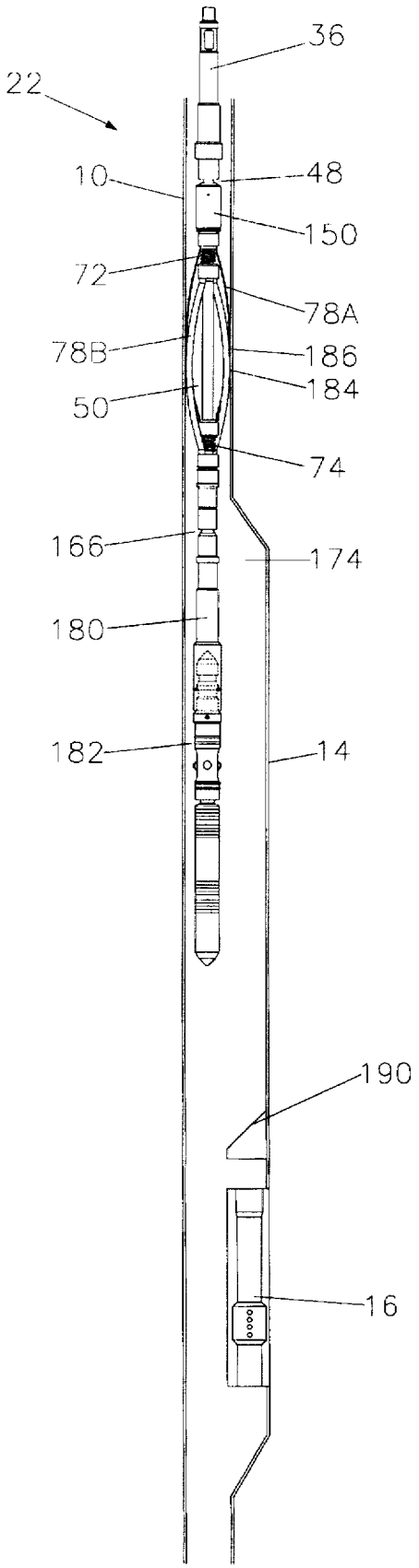
FIG. 5 is an illustration of the embodiment of FIG. 4 with a gas lift valve attached thereto being lowered into a gas lift side pocket mandrel.
Figure 6:
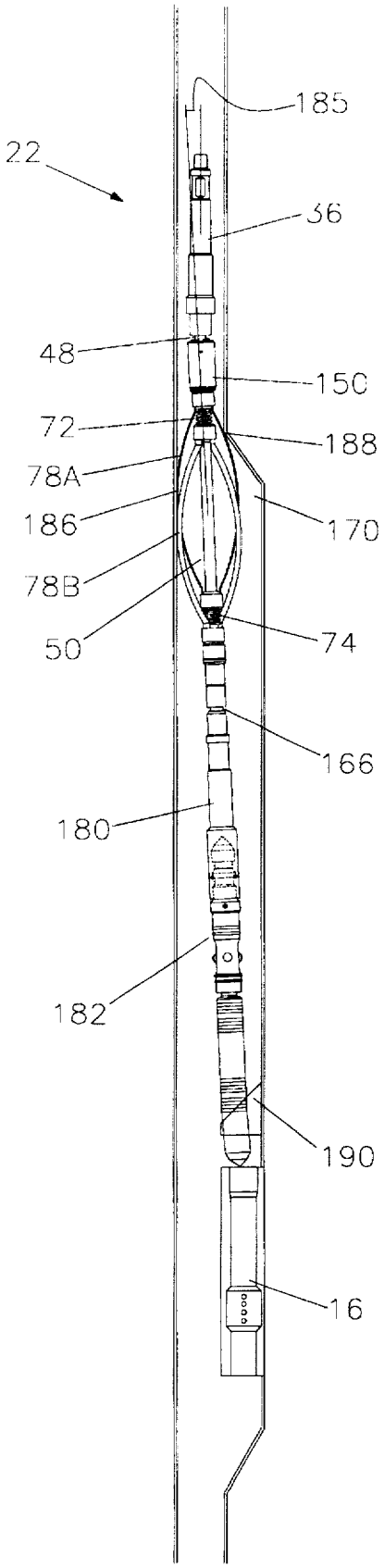
FIG. 6 is the illustration of FIG. 5 with the gas lift valve being guided into the pocket of the gas lift mandrel.
Figure 7:
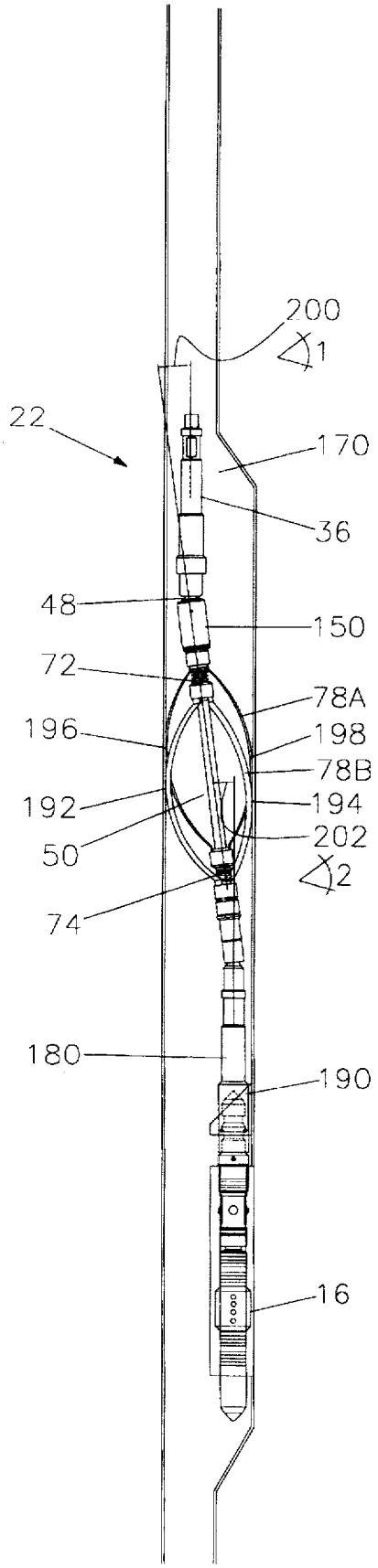
FIG. 7 is the illustration of FIG. 6 with the gas lift valve being guided into the pocket of the gas lift mandrel.

Referring now to FIGS. 5, 6, and 7, the operation of the device 22 will now be described. The device 22 will be lowered via a work string which in the preferred embodiment will be wire line, even though it should be understood that the device could be attached to other types of work strings such as coiled tubing.

The device of FIGS. 5, 6, and 7 includes the eight spring 78 embodiment of FIGS. 2 and 4. The bottom hole assembly will contain the first and second deflection means 48/166 respectfully. There is also included a setting tool 180 that is used to selectively detach the gas lift valve 182 into the gas lift pocket 16. As seen in FIG. 5, the springs 78 contact the production conduit 10 at two separate axial planes, namely 184 and 186. Thus, the springs 78 act to align the device in a proper orientation, which in the lowering of the device 22 within the production conduit 10 is essentially in the center of the conduit 10.

It should also be noted that as the bottom hole assembly is being either lowered or raised, the operator may encounter tight spots within the conduit 10. In these cases, the coiled springs 72, 74 may give (due to the inherent resiliency of the coil springs) thereby allowing the bow spring sets 78A and 78B to expand and contract as necessary in order to get past these tight spots.

As seen in FIG. 6, once the bow springs 78 reach the side pocket gas lift mandrel 14, and in particular, reach the belly portion 170 of the mandrel 14, the springs 78B will be first to expand. Thus, at least one individual member of the spring set 78B will bear against the mandrel, while at least one individual member of the spring set 78B will be free to expand into the belly portion 170 which results in the mandrel 50 oriented, or kicked over, relative to the centerline of the production conduit at an angle 185 as seen in FIG. 6 so that the device 22 is better aligned with the pocket 16.

As seen in FIG. 6, the springs 78A are still being restrained by the side pocket mandrel 14. The point of contact of springs 78A is 186 and 188 which are in two different axial planes and aids in the orientation, or kicking over, of the device 22 relative to the centerline of the production conduit so that the device 22 is better aligned with the pocket 16. As the device 22 is continued to be lowered, the gas lift valve 182 will be guided through the discriminator 190.

Referring now to FIG. 7, the device has been lowered so that the gas lift valve 182 is now seated within the pocket 16. The spring set 78A is contacting at points 192 and 194; the spring set 78B is contacting at points 196 and 198. By having the force of the two contact points 192 & 196 distributed between two sets of spring 78A & 78B, the aligning means is thus able to better align, or kick over, the device 22 with reference to the discriminator 190 and pocket 16.

The FIG. 7 also shows the first deflection means 48 deflection with the angle 200 being formed from the centerline of the body 30 relative to the mandrel 50. The second deflection means 166 allows the angle 202 to be formed from the centerline of the mandrel 50 relative to the centerline of the gas lift valve 182. The first angle 200 and second angle 202 allow for easier deflection of the valve 182 into the pocket 16 since it results in two bend points.

Once the valve 182 has been seated into the pocket 16, the remainder of the bottom hole assembly may be retrieved from the production conduit 10. In order to retrieve a gas lift valve from a mandrel, the previously described bottom hole assembly may be employed except that a retrieving tool (for retrieving the gas lift valve) is placed thereon. The features of spring action and deflection remain the same as described in FIGS. 5, 6, and 7.

In most gas lift installations, the production conduit may contain a series of mandrel. Due to the nature of the difference of hydrostatic pressure between the annulus 14 and hydrostatic within the production conduit 10, the operator may wish to balance the pressures. Thus, in order to prevent the u-tubing effect, as is well understood by those of ordinary skill in the art, the operator will pull the bottom most gas lift valve.

When the operator is retrieving the bottom most valve, it will be necessary to pin the shifting sleeve as shown in FIGS. 2A–2B thereby making the hook-up stiff because it is necessary to by-pass all of the other mandrels located within the production conduit 10. Once the bottom side pocket gas lift mandrel is reached, the operator will bump the jars in order to shear the shifting sleeve 150 down. In other operations, the operator may use a set screw through the aperture—so that the deflection means 48 is free to deflect. It should be noted that when the operator is setting the gas lift valves, the shifting sleeve is pinned so that the first deflection means is allowed to deflect.

Changes and modifications in the specifically described embodiments can be carried out without departing from the scope of the invention which is intended to be limited only by the scope of the appended claims.

I claim:

1. An apparatus for use in a well bore comprising:

a body;

a first joint attached to said body, said first joint having a shifting barrel attached thereto, and first selective means for selectively releasing said shifting barrel from attachment with said first joint;

a mandrel attached to said flexible joint;

a first coil spring having an initial tension therein, with said first coil spring being disposed about said mandrel;

a first expanded bow spring having a first end and a second end, with the first end being operatively associated with said first coil spring;

spring adjusting means for adjusting the tension in said first coil spring comprising a first housing disposed about said mandrel and operatively associated with said first coil spring;

a second coil spring disposed about said mandrel;

a second expanded bow spring having a first end and a second end, with the first end being operatively associated said second coil spring;

a second joint attached to said body; and, second selective means for selectively releasing said shifting barrel from attachment with said second joint.

2. The apparatus of claim 1 further comprising:

second spring adjusting means for adjusting the tension in said second coil spring.

3. The apparatus of claim 2 wherein said body is attached to a wire line string and said mandrel is attached to a gas lift valve.

4. The apparatus of claim 2 wherein said body is attached to a wire line string and said mandrel is attached to a retrieving tool.

* * * * *